US006008460A

United States Patent [19]

Demari

[11] Patent Number: 6,008,460

[45] Date of Patent: Dec. 28, 1999

[54] ELEMENT FORMING AN ELECTRIC PUSH-BUTTON

[75] Inventor: Daniel Demari, Moissac, France

[73] Assignee: Apem, Caussade, France

[21] Appl. No.: 08/961,422

[22] Filed: Oct. 30, 1997

[30] Foreign Application Priority Data

Nov. 6, 1996 [FR] France ..... 96 13536

[51] Int. Cl.[6] ..... H01H 3/12; H01H 13/48

[52] U.S. Cl. ..... 200/406; 200/61.54; 200/516; 200/302.2

[58] Field of Search ..... 200/5 A, 5 R, 200/16 R–16 D, 61.54, 61.55, 402, 405, 406, 408, 453, 460, 512, 513, 516, 517, 520, 341, 534, 302.2

[56] References Cited

U.S. PATENT DOCUMENTS

| | | | |
|---|---|---|---|
| 3,921,750 | 11/1975 | Shames | 180/103 |
| 4,029,916 | 6/1977 | Chu | 200/5 A |
| 4,031,348 | 6/1977 | Eberhardt | 200/159 R |
| 4,170,104 | 10/1979 | Yamagata | 58/23 R |
| 4,304,973 | 12/1981 | Fenelle et al. | 200/330 |
| 4,386,254 | 5/1983 | Eberhardt et al. | 200/339 |
| 4,417,294 | 11/1983 | Herron, Jr. | 361/288 |
| 4,439,646 | 3/1984 | Bouvrande | 200/5 A |
| 4,861,950 | 8/1989 | Yanai et al. | 200/5 R |
| 4,934,735 | 6/1990 | Embach | 280/731 |
| 4,978,818 | 12/1990 | Rothlin | 200/406 |
| 5,172,114 | 12/1992 | Bedoya et al. | 341/27 |
| 5,199,557 | 4/1993 | Brandt et al. | 200/406 |
| 5,765,860 | 6/1998 | Osborn et al. | 280/728.2 |
| 5,767,466 | 6/1998 | Durrani | 200/61.54 |

FOREIGN PATENT DOCUMENTS

| | | | |
|---|---|---|---|
| 0 446 088 | 9/1991 | European Pat. Off. | H01H 13/70 |
| 0 461 529 | 12/1991 | European Pat. Off. | H01H 13/70 |
| 8201100 | 4/1982 | WIPO | H01H 13/70 |

*Primary Examiner*—Michael Friedhofer
*Attorney, Agent, or Firm*—Pennie & Edmonds LLP

[57] ABSTRACT

An element forming an electric push-button, characterized in that it comprises a part (6) made from an elastically deformable material and accommodated in the stationary body (1) of the element underneath the operating key (3) so as to adjust according to the material used for the deformable part (6), the force for depressing the key (3) for deforming the contact cup (4), the invention being applicable in particular to steering wheels of automotive vehicles.

5 Claims, 2 Drawing Sheets

ELEMENT FORMING AN ELECTRIC PUSH-BUTTON

TECHNICAL FIELD

The present invention relates essentially to an element forming an electric push-button which may be for example used with electric keyboards for making an electric contact and producing a particular operating or control signal.

BACKGROUND ART

There is known an element forming an electric push-button of the type comprising a key which may be depressed or driven into a stationary body for deforming a metal contact cup from a determined stroke of the key and providing an electric contact.

However, this known element forming a push-button is designed in such a manner that the force for depressing the key depends only of the force required to deform the electric contact cup.

It may be advantageous in some applications to provide an element forming an electric push-button permitting to adjust the key-depressing force independently of the electric contact and/or of the mechanism for operating the contact.

SUMMARY OF THE INVENTION

For that purpose the invention provides an element forming an electric push-button comprising a key which may be depressed or driven into a stationary body for deforming a metal contact cup from a determined stroke of the key and making an electric contact and which is characterized in that it comprises a part made from an elastically deformable material accommodated in the stationary body underneath the key so as to adjust, according to the material used for the deformable part, the force for depressing the key to deform the contact cup.

The key of the element is bearing on the one hand upon one peripheral portion of the deformable part with a bottom face of a peripheral flange of the key formed at the lower portion of the latter and on the other hand through the reaction force of the deformable part upon a peripheral ledge of the stationary body which defines an opening for the passage of the key, with the top face of the peripheral flange of the key.

Advantageously, the bottom face of the peripheral flange of the key is bearing upon the deformable part through the medium of a circular bead or pad made fast to this face.

According to one embodiment, the key comprises a central stud bearing upon the top of the contact head and having a height substantially equal to the thickness of the deformable part.

This deformable part is preferably shaped as a washer the central hole of which contains the contact cup.

According to another embodiment, the deformable part comprises a base portion upon the top face of which is bearing the circular bead or pad of the key and which is in contact with the top of the contact cup; a first projecting annular portion made fast to the bottom face of the base portion and bearing upon one portion forming the bottom of the stationary body so as to form with the base portion a recess for holding the contact cup; and a second projecting annular portion made fast to the top face of the base portion and bearing upon the bottom portion of the key.

The base portion of the deformable part comprises a central hollow in the shape of a concave portion of a sphere in which is accommodated the complementarily shaped top of the contact cup.

Preferably the first and second projecting annular portions have the same height and the second annular portion has a smaller diameter than that of the first annular portion approximately located plumb with the circular bead.

Advantageously, the deformable part is made from a foam or elastomer material.

The invention also provides a device forming a keyboard with at least one element forming a push-button such as previously defined and which is characterized in that the body of the element forming a push-button is fastened onto a flexible membrane of the keyboard through the agency of a rigid fastening plate located on the other side of the flexible membrane and the contact cup comprises several lugs connected to electric contact points of the membrane which are connected to at least one particular electric control or operating circuit.

Preferably the device forming a keyboard is used for controlling the audible warning device or horn circuit of an automotive vehicle and is mounted onto the steering wheel of this vehicle.

In such an application, the flexible membrane of the device forming a keyboard is arranged behind an air-bag integrated into the steering wheel of the vehicle.

Preferably the flexible membrane comprises four elements forming push-buttons fastened substantially to the four corners or vertices thereof.

BRIEF DESCRIPTION OF THE DRAWINGS

The invention will be better understood and further objects, characterizing features, details and advantages thereof will appear more clearly as the following explanatory description proceeds with reference to the attached diagrammatic drawings given by way of non limiting examples only illustrating two embodiments of the invention and in which.

DESCRIPTION OF THE INVENTION

Figure 1:
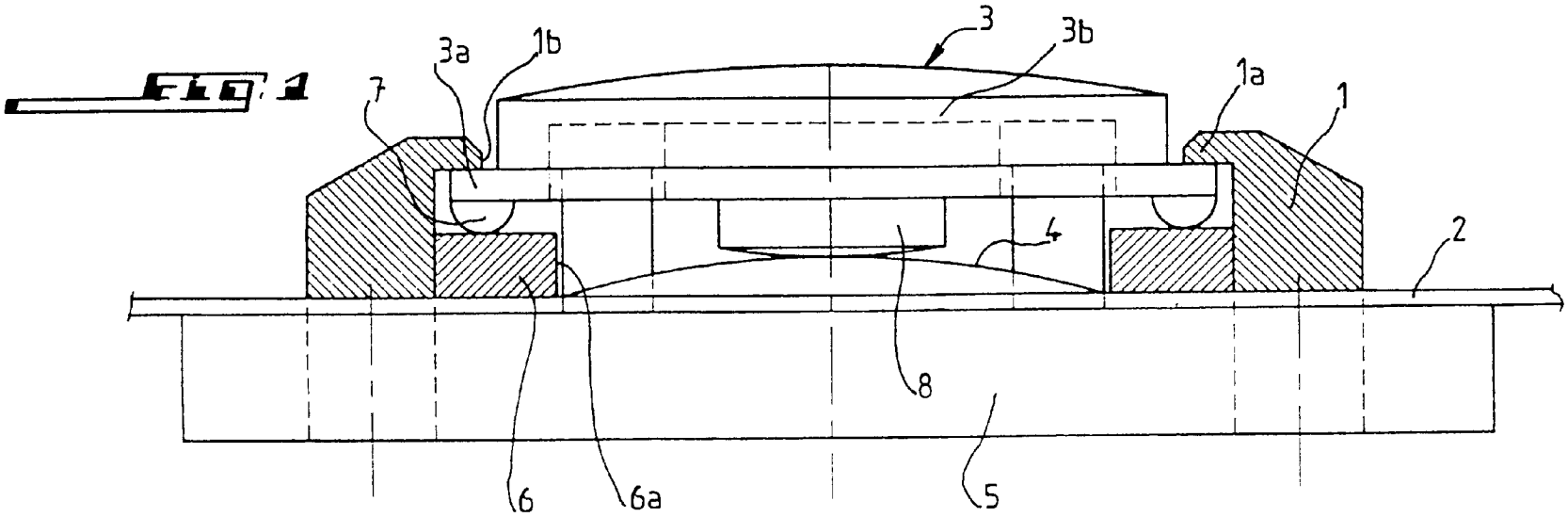
FIG. 1 is a view in section of an element forming an electric push-button according to a first embodiment of the invention.

The element forming an electric push-button such as shown on FIG. 1 is of the type comprising a body 1 with a generally cylindrical shape fastened onto a support 2 such as the plate of a printed circuit whereas a flexible membrane or the like may form part of a keyboard device; one key 3 retained in the stationary body 1 and which may be depressed or driven axially into the latter to deform a metal contact cup 4 from a determined stroke of the key 3 and to make an electric contact. The contact cup 4 housed within the body 1 comprises as known per see a number of lugs (not shown), for example in a number of four electrically connected to electric metal contact points, respectively, of the support 2 which are connected to one or several particular electric circuits through the medium of conducting tracks (not shown) of the support 2. The deformation by the key 3 of the cup 4 causes the latter to be brought into engagement with a central electric contact point for causing the electric current to circulate between the different electric contact points associated with the lugs, respectively, of the cup.

In the case where the support 2 is constituted by a flexible membrane made from a plastics material into which are engraved the electric contact points and the conducting tracks or pads referred to hereinabove, the body 1 is secured to the membrane 2 through the medium of a rigid fastening plate or base 5 located on that side of the membrane 2 which is opposite to that where the body 1 is resting so that this membrane be sandwiched between the body 1 and the fastening plate 5 which may be circular. The fastening of the body 1 to the plate 5 may be carried out with small cylindrical metal pins (not shown) force-fitted into the plate 5 and the body 1 while extending through the membrane 2 transversely thereof as shown by the pecked lines on FIG. 1.

According to the invention, the push-button element also comprises a part 6 made from a resiliently deformable material accommodated in the body 1 between the key 3 and the support 2 forming the bottom of the body 1 so as to adjust, according to the material used for the deformable part 6, the force for depressing the key 3 for deforming the contact cup 4.

Preferably the deformable part 6 is made from a plastic foam material which at the same time provides the fluid-tightness of the push-button element.

The deformable piece 6 preferably has the shape of a washer into the central hole 6*a* of which is housed and held the contact cup 4.

The key 3 is bearing upon an upper peripheral portion of the deformable part 6 with a bottom face of a peripheral flange 3*a* of the key 3 formed at the lower portion of this key and on the other hand through the reaction force of the deformable part 6 upon a peripheral ledge 1*a* of the body 1 which defines an opening 1*b* forming the passageway of the external cylindrical portion 3*b* of the key, with the top face of the peripheral flange 3*a* of this key.

Preferably, the bottom face of the peripheral flange 3*a* of the key 3 is bearing upon the deformable part 6 through the agency of a circular bead 7 made fast to this face.

The key 3 also comprises a central cylindrical stud 8 bearing upon the top of the contact cup 4 and having a height substantially equal to the thickness of the deformable part 6.

To deform the contact cup 4 and thus make an electrical contact through the latter with the support 2, the operator should exert upon the key 3 a predetermined depressing force depending of the material used for making the deformable part 6. Thus by changing the type of material used for making the deformable piece 6, the force required to depress the key 3 and to deform the metal cup 4 is also changed. The material of the part 6 is defined in the factory or workshop according to the depressing force desired for the key.

Figure 2:
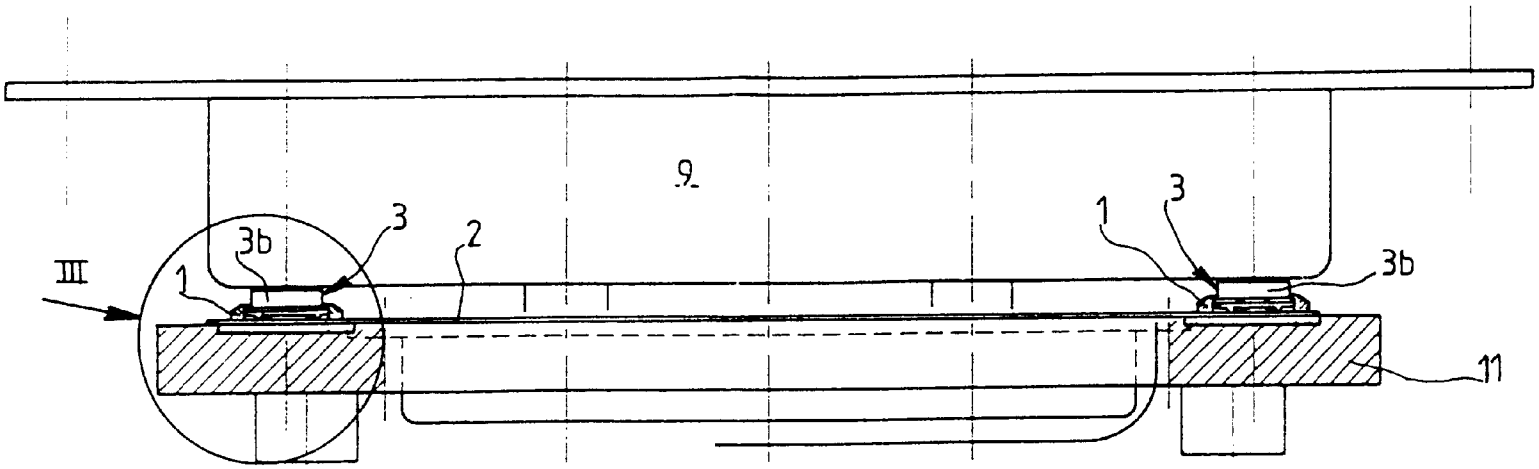
FIG. 2 is a diagrammatic view of a device forming a keyboard with several elements forming push-buttons according to a second embodiment of the invention and mounted behind the air-bag integrated into the steering wheel of an automotive vehicle.

FIG. 2 shows in a non limiting manner the particular application of a keyboard device of the type with a flexible membrane of the kind of that shown on FIG. 1 for controlling the electric circuit of an audible warning device or horn of an automotive vehicle, the keyboard device being then mounted onto the steering wheel of the latter, preferably behind an air-bag system accommodated in a box or casing 9 integrated into the steering wheel.

Figure 4:
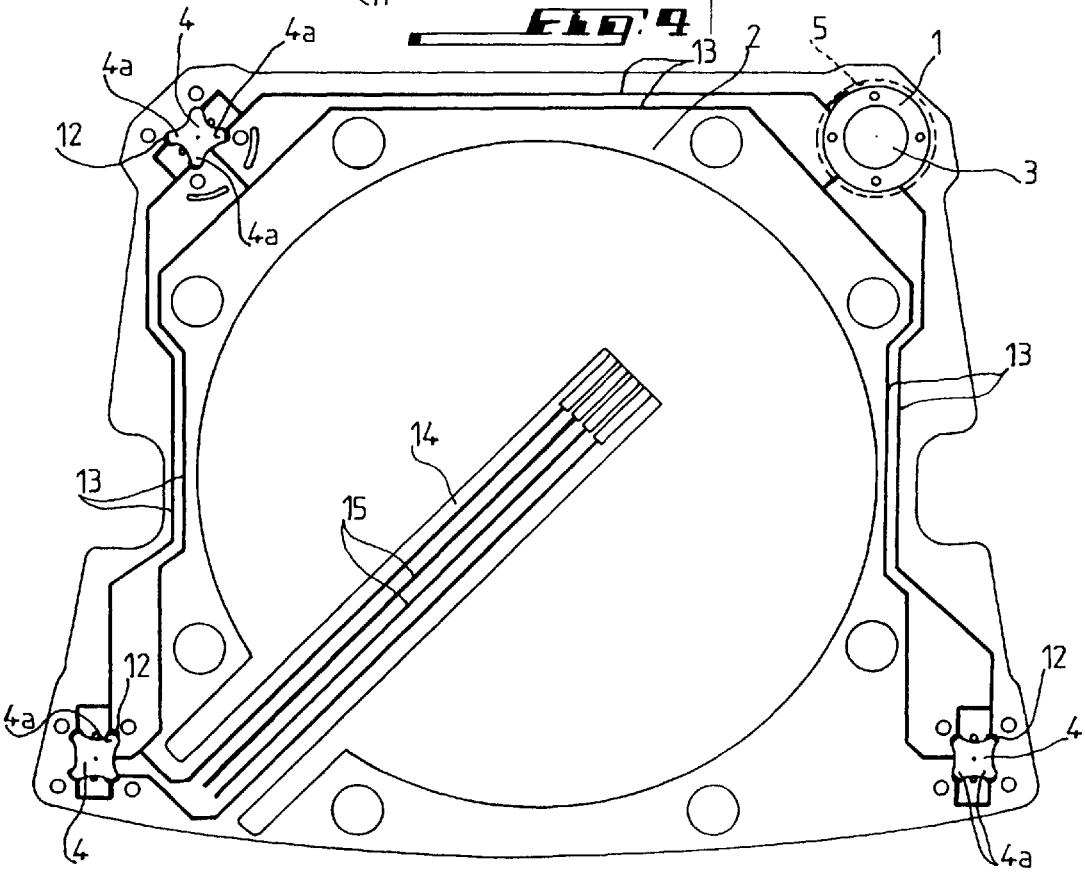
FIG. 4 is a top view of a flexible membrane with at least one element forming an electric push-button according to the invention and which may be used in the keyboard device of FIG. 2.

The flexible membrane of this keyboard device may comprise a number of push-button elements of the type shown on FIG. 1, for example four push-button elements fastened at four corners or vertices, respectively, of the membrane as this will be seen with reference to FIG. 4 so as to allow the driver of the automotive vehicle to make use of the audible warning device or horn by actuating, by pushing upon the steering wheel, one of these four elements.

Figure 3:
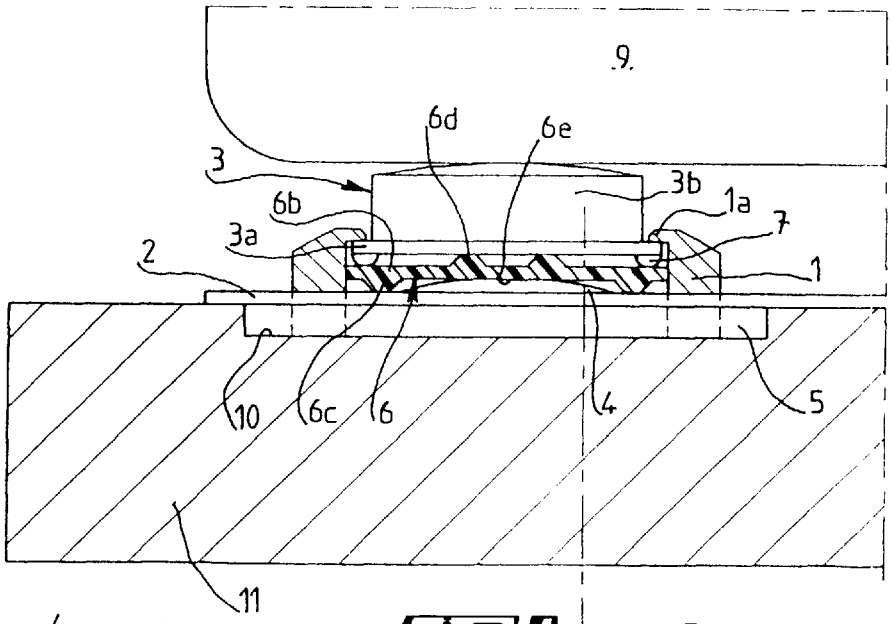
FIG. 3 is an enlarged view of the portion circled at III of FIG. 2 of an element forming a push-button of the second embodiment of the invention.

However, FIG. 2 in connection with FIG. 3 shows another possible embodiment of each push-button element according to the invention which may be mounted onto the membrane 2 instead of the element of FIG. 1.

According to this element, the components of which, identical with those of the element of FIG. 1 or accomplishing the same functions, carry the same reference numerals, the deformable part 6 comprises a base portion 6*b* on the top face of which is bearing the circular bead 7 of the key 3, the portion 6*b* being in contact with the top of the contact cup 4; a first projecting annular portion 6*c* made fast to the bottom face of the base portion 6*b* of the part 6 and bearing upon the membrane 2 so as to form together with the base portion 6*b* a recess for holding the contact cup 4; and a second projecting annular portion 6*d* made fast to the top face of the base portion 6*b* and bearing upon the bottom portion of the key 3 including the annular flange 3*a*.

The first and second projecting annular portions 6*c*, 6*d* have the same height and the second annular portion 6*d* has a smaller diameter than that of the first annular portion 6*c* which is approximately located plumb with the circular bead 7.

By modifying the heights of the projecting annular portions 6*c*, 6*d* of the deformable part 6 for a same material of the latter, one also modifies the force required for depressing the key 3 to deform the contact cup 4. It is thus possible for each type of steering wheel to use a push-button element with a suitable force for depressing its key by adopting a deformable part 6 the annular portions 6*c*, 6*d* of the latter have a height predetermined in the factory or workshop according to the type of steering wheel used.

The base portion 6*b* of the deformable part 6 comprises a central hollow 6*e* shaped as a concave portion of a sphere in which is housed the complementarily shaped top of the contact cup 4 so as to positively hold the cup underneath the deformable part 6.

Each circular fastening plate 5 of a push-button element secured to the membrane 2 is fitted into a recess 10 with a complementary mating shape provided in the top face of a plate for fastening the whole assembly to the steering wheel with the membrane 2 being bearing upon this top face.

FIG. 4 shows a flexible membrane 2 of a keyboard device mounted within the steering wheel of an automotive vehicle for actuating the audible warning device or horn of the latter.

This figure shows the membrane 2 provided with a complete push-button element fastened at the right-hand corner and of which one sees the body 1, the key 3 as well as through transparency the fastening plate or base 5. The other push-button elements located in the three other corners, respectively, of the membrane 2 have not been fully shown since the metal contact cup 4 only of each one of them is appearing and comprises the four lugs 4*a* electrically connected to the corresponding electric contact points 12 of which one catches a glimpse in part on FIG. 4 and which are electrically connected to the conducting tracks or pads 13 engraved into the membrane 2. The conducting tracks or pads 13 are connected to a sheet 14 of connecting conducting tracks or pads 15 connected to the electrical circuit of the audible warning device or horn of the automotive vehicle so as to activate it when one of the keys 3 of a push-button element is depressed.

By securing the keyboard device provided with the membrane 2 and with its push-button elements behind the air-bag of the steering wheel of the vehicle, the entireness of this device is retained when the air-bag explodes upon a frontal impact of the vehicle.

The push-button element according to the invention described hereinabove exhibits a bearing force of its corresponding key which is independent of the electric contact and/or of the mechanism operating this contact and this contrary to the known push-button elements. Moreover, the deformable part of this element effectively prevents the vibration of the corresponding cup which are likely to induce parasitic or spurious noises. The push-button element according to the invention is applicable to any type of keyboard to form so-called tactile keys.

What is claimed is:

1. A push-button for completing an electrical circuit comprising:

a stationary body fastened to a support and having a peripheral ledge defining an opening;

a key depressable into the opening of the stationary body, said key having a peripheral flange at a lower portion of the key, the peripheral flange having a lower face and an upper face retained within the stationary body by the peripheral ledge;

a deformable conductive contact cup located beneath the key such that when a sufficient key depressing force is applied, the contact cup deforms to make an electrical contact and complete the electrical circuit;

a circular bead attached to the lower face of the peripheral flange; and a deformable member made from an elastically deformable material and removably accommodated in the stationary body beneath the key, said deformable member comprising:

a base portion having a top face in contact with the circular bead and a bottom face in contact with a top portion of the contact cup;

a first projecting annular portion having a first thickness extending from the bottom face of the base portion and contacting a portion of a bottom of the stationary body so as to form a recess for holding the contact cup; and a second projecting annular portion having a second thickness extending from the top face of the base portion and contacting the key, wherein the deformable member substantially determines the sufficient key depressing force.

2. The push-button of claim 1, wherein the base portion of the deformable member comprises a central hollow in the shape of a concave portion of a sphere for accommodating the top portion of the contact cup.

3. The push-button of claim 1, wherein the first and second projecting annular portions have substantially identical thicknesses.

4. The push-button of claim 1, wherein the second projecting annular portion has a smaller diameter than that of the first projecting annular portion and is located substantially plumb with the circular bead.

5. A keyboard for controlling an electric circuit of an audible warning device or horn of an automotive vehicle comprising:

a rigid fastening plate;

a flexible membrane having electrical contact points which are connected to the electric circuit;

at least one push-button comprising:

a stationary body fastened to a support and having a peripheral ledge defining an opening;

a key depressable into the opening of the stationary body, said key having a peripheral flange at a lower portion of the key, the peripheral flange having a lower face and an upper face retained within the stationary body by the peripheral ledge;

a deformable conductive contact cup located beneath the key such that when a sufficient key depressing force is applied, the contact cup deforms to make an electrical contact and complete the electrical circuit; and a deformable member having a peripheral portion and made from an elastically deformable material, said deformable member removably accommodated in the stationary body with the lower face of the key bearing upon the peripheral portion of the deformable member, wherein the deformable member has a thickness and elastomeric properties which substantially determine the sufficient key depressing force;

each push-button is fastened onto the flexible membrane, the flexible membrane is fastened onto the rigid fastening plate, and the contact cup is fastened to the electric contact points of the membrane by a plurality of lugs; and the membrane is integrated into a steering wheel of the vehicle and arranged behind an air-bag.

* * * * *